US005078671A

United States Patent [19]

Dennehey et al.

[11] Patent Number: 5,078,671

[45] Date of Patent: Jan. 7, 1992

[54] CENTRIFUGAL FLUID PROCESSING SYSTEM AND METHOD

[75] Inventors: T. Michael Dennehey, Arlington Heights; Joseph C. West, Jr., Vernon Hills, both of Ill.

[73] Assignee: Baxter International Inc., Deerfield, Ill.

[21] Appl. No.: 598,753

[22] Filed: Oct. 12, 1990

Related U.S. Application Data

[63] Continuation of Ser. No. 255,127, Oct. 7, 1988, abandoned.

[51] Int. Cl.[5] ..... B04B 11/06

[52] U.S. Cl. ..... 494/27; 494/37; 494/45

[58] Field of Search ..... 494/16, 17, 18, 27, 494/28, 37, 45; 422/72

[56] References Cited

U.S. PATENT DOCUMENTS

| | | | |
|---|---|---|---|
| 1,931,508 | 10/1933 | Reese et al. | 494/37 |
| 1,954,676 | 8/1931 | Lindberg . | |
| 2,261,394 | 5/1938 | Lindgren . | |
| 2,269,716 | 11/1939 | Gregg . | |
| 2,321,144 | 2/1940 | Jones . | |
| 2,662,687 | 4/1950 | Spross . | |
| 2,719,668 | 8/1953 | Bergner . | |
| 3,096,282 | 12/1957 | Trotter, Jr. . | |
| 3,285,507 | 11/1966 | Shapiro | 494/27 |
| 3,698,626 | 10/1972 | Kotrappa et al. . | |
| 3,957,197 | 5/1976 | Sartory et al. . | |
| 4,007,871 | 2/1977 | Jones et al. . | |
| 4,010,894 | 3/1977 | Kellogg et al. . | |
| 4,069,968 | 1/1978 | Herman . | |
| 4,091,989 | 5/1978 | Schlutz . | |
| 4,094,461 | 6/1978 | Kellogg et al. . | |
| 4,113,173 | 9/1978 | Lolachi . | |
| 4,120,448 | 10/1978 | Cullis . | |
| 4,146,172 | 3/1979 | Cullis et al. . | |
| 4,185,629 | 1/1980 | Cullis et al. . | |
| 4,187,979 | 2/1980 | Cullis et al. . | |
| 4,230,263 | 10/1980 | Westberg . | |
| 4,261,507 | 4/1981 | Baumler . | |
| 4,278,202 | 7/1981 | Westberg . | |
| 4,303,193 | 12/1981 | Latham, Jr. . | |
| 4,322,298 | 3/1982 | Persidsky . | |
| 4,344,560 | 8/1982 | Iriguchi et al. . | |
| 4,386,730 | 6/1983 | Mulzet | 494/81 |
| 4,387,848 | 6/1983 | Kellogg et al. | 494/81 |
| 4,419,089 | 12/1983 | Kolobow et al. | 494/45 |
| 4,421,503 | 12/1983 | Latham, Jr. et al. | 494/17 |
| 4,425,112 | 1/1984 | Ito | 494/18 |
| 4,430,072 | 2/1984 | Kellogg et al. | 494/45 |
| 4,439,178 | 3/1984 | Mulzet | 494/85 |
| 4,445,883 | 5/1984 | Schroendorfer | 494/21 |
| 4,447,221 | 5/1984 | Mulzet | 494/45 |
| 4,493,691 | 1/1985 | Calari | 494/10 |
| 4,531,932 | 7/1985 | Luppi et al. | 494/18 |
| 4,617,009 | 10/1986 | Ohlin et al. | 494/21 |
| 4,647,279 | 3/1987 | Mulzet et al. | 494/45 |
| 4,668,214 | 5/1987 | Reeder | 494/37 |
| 4,708,712 | 11/1987 | Mulzet | 494/45 |
| 4,710,161 | 12/1987 | Takabayashi et al. | 494/84 |
| 4,743,227 | 5/1988 | Takeuchi | 494/85 |
| 4,772,388 | 9/1988 | Allington | 210/198.2 |
| 4,778,444 | 10/1988 | Westberg et al. | 494/56 |
| 4,790,807 | 12/1988 | Neumann et al. | 494/45 |
| 4,795,314 | 1/1989 | Prybella et al. | 494/1 |
| 4,798,579 | 1/1989 | Penhasi | 494/18 |
| 4,806,252 | 2/1989 | Brown et al. | 494/18 |
| 4,834,890 | 5/1989 | Brown et al. | 494/18 |

FOREIGN PATENT DOCUMENTS

| | | | |
|---|---|---|---|
| 0043693 | 7/1888 | Fed. Rep. of Germany | 494/45 |
| 88/05691 | 8/1988 | PCT Int'l Appl. . | |
| 873494 | 7/1961 | United Kingdom | 494/37 |
| 2002266 | 2/1979 | United Kingdom . | |

*Primary Examiner*—Frankie L. Stinson

*Attorney, Agent, or Firm*—Paul C. Flattery; Bradford R. L. Price; Daniel D. Ryan

[57] ABSTRACT

A centrifugal processing system and method introduces fluid to be processed into a centrifugation chamber, while directing the fluid away from the region of the chamber where the largest centrifugal (or "G") forces exist. The fluid is also conveyed into the force field as a generally uniform stream having reduced turbulence or being essentially free of turbulence. The system and method thereby establish, upon the entry of a high velocity fluid stream into the centrifugal field, non-turbulent and uniform flow conditions conducive to effective separation. The system and method also direct the fluid in a way the maximizes the effective surface area of the centrifugation chamber for separation. Effective separation can thereby be achieved at high inlet flow rates.

5 Claims, 4 Drawing Sheets

72
74

44
46
42
34
14
200
58
68
64
62
60

46
34
54
36
114
38
116
42
32
40
120
44
118
56
54

CENTRIFUGAL FLUID PROCESSING SYSTEM AND METHOD

This is a continuation of copending application Ser. No. 07/255,127 filed on Oct. 7, 1988 now abandoned.

FIELD OF THE INVENTION

The invention generally relates to systems and methods for separating fluids by centrifugation. More particularly, the invention relates to the centrifugation of large volumes of fluids at relatively high flow rates. In this respect, the invention also relates to systems and methods particularly well suited for the processing of cultured cells and supernatant, such as in the fields of biotechnology and adoptive immunotherapy.

BACKGROUND OF THE INVENTION

Many fluid processing techniques entail the centrifugation of large volumes of fluids. To minimize processing times, these techniques often require the use of relatively high flow rates. Increasingly, such techniques are being used in the medical field.

For example, in the areas of biotechnology and adoptive immunotherapy, it is necessary to process relatively large volumes of cultured cellular products by centrifugation. Through centrifugation, cultured cells are separated from the supernatant for the purpose of replacing-/exchanging the culture medium; or for providing a cell-free supernatant for the subsequent collection of antibodies or for subsequent use as an additive to culture medium; or for the collection of concentrated cellular product.

In the area of adoptive immunotherapy, it has been possible to process between 10 to 50 liters of cultured LAK (Limphokine Activated Killer) cells at a rate of 175 ml/min using conventional centrifugation techniques and devices previously used in whole blood processing. However, in the processing of TIL (Tumor Infiltrating Lymphocytes), the volume of cultured cells that must be processed is increased by an order of magnitude to approximately 100 to 400 liters. Conventional blood processing techniques and devices cannot effectively deal with these large fluid volumes and the attendant need to increase the processing rates.

Furthermore, the necessarily high inlet flow rates can lead to confused, turbulent flow conditions within the centrifugation chamber. These flow conditions are not desireable, because they can interfere with sedimentation and separation within the centrifugal force field. Thus, despite the high inlet flow rates, the overall effectiveness and efficiency of the process suffers.

High inlet flow rates and resulting confused, turbulent flow conditions can also result in a non-uniform distribution of the fluid within the centrifugation chamber.

Often, then, it is necessary to reduce the inlet flow rate below the desired amount in the interest of obtaining the flow conditions within the processing chamber conducive to optimal separation.

SUMMARY OF THE INVENTION

The invention provides systems and methods for centrifugally processing large volumes of fluid at relatively high flow rates without sacrificing separation efficiencies or damaging the end product.

In one aspect, the invention provides a centrifugal processing system and method in which a centrifugal force field is developed within a chamber. As the fluid to be processed is introduced into the chamber, it is directed away from the region of the chamber where the largest centrifugal (or "G") forces exist. The fluid is also preferably conveyed into the force field in a generally uniform stream. As used herein, the term "generally uniform" describes a flow condition in which turbulence is reduced or eliminated to the fullest extent possible.

In accordance with this aspect of the invention, the system and method establish, upon the entry of high velocity fluid into the centrifugal field, generally uniform flow conditions conducive to effective separation. The system and method also direct the fluid in a way that maximizes the effective surface area of the centrifugation chamber for separation. Effective separation can thereby be achieved at high inlet flow rates.

Preferably, the system and method embodying the features of the invention also create within the chamber a region where the higher density materials collect, while allowing the supernatant to freely flow out of the chamber.

In another aspect of the invention, the centrifugation chamber takes the form of a tube or envelope. In this embodiment, a passage is formed within the tube adjacent to its inlet end. All fluid entering the tube is directed through this passage and into the centrifugal force field. The passage creates a generally uniform stream of fluid having reduced turbulence or being essentially free of turbulence. This stream is directed and dispensed uniformly into the region of the tube where the least centrifugal forces exist.

Other features and advantages of the invention will become apparent upon considering the accompanying drawings, description, and claims.

BRIEF DESCRIPTION OF THE DRAWINGS

FIG. 9 is an alternate embodiment of a centrifugal fluid processing system embodying the features of the invention.

DESCRIPTION OF THE PREFERRED EMBODIMENTS

Figure 1:
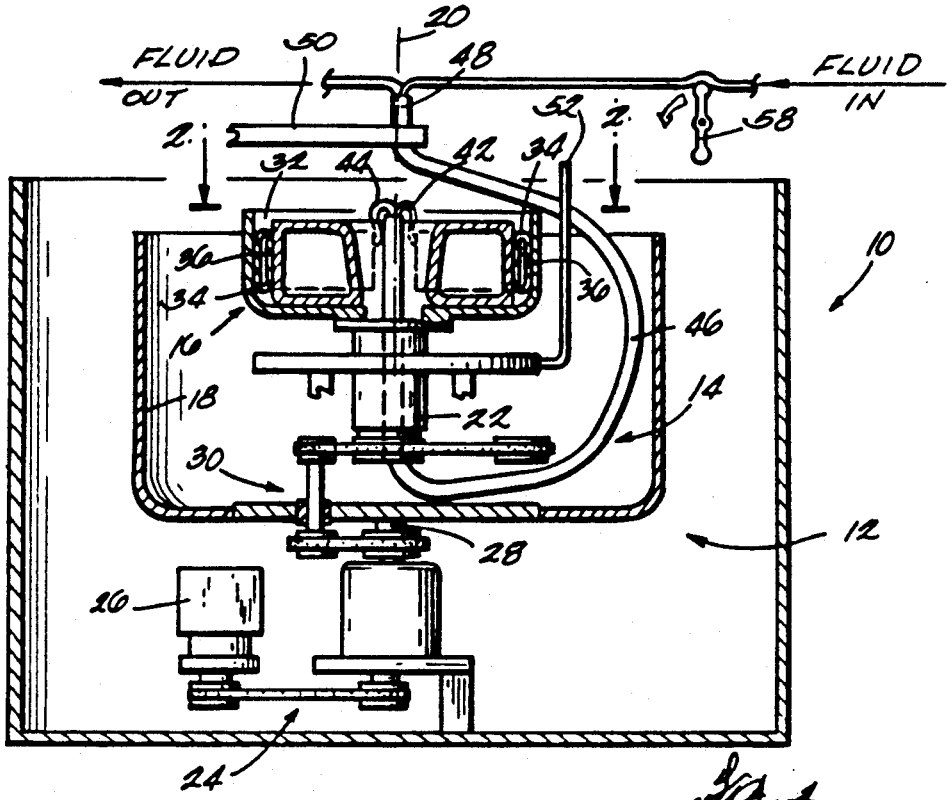
FIG. 1 is a schematic side view, fragmented and partially in section, of a centrifugal processing system embodying the features of the invention.

A centrifugal fluid processing system 10 embodying the features of the invention is shown in FIG. 1. The system 10 includes a centrifuge 12 and an associated fluid processing set 14. In the illustrated and preferred embodiment, the set 14 is disposable, intended to be used once and then discarded.

The system 10 can be used to process many different types of fluid. As will become apparent, the system 10 is capable of efficiently processing large volumes of fluid at relatively high flow rates. At the same time, the system 10 is well adapted to handle special fluids containing living cells or delicate organisms, such as blood or cultured cell suspensions, both on a clinical basis and an industrial basis. For this reason, the system 10 is particularly well suited for use in the medical field. For this reason, the system 10 will be described as being used in this particular environment.

The centrifuge 12 can be variously constructed. However, in the illustrated embodiment, the centrifuge 12 is shown to incorporate the principles of operation disclosed in Adams U.S. Pat. No. Re 29,738.

In this arrangement (as best shown in FIG. 1), the centrifuge 12 includes a processing assembly 16 and a rotor assembly 18 each of which independently rotates about the same axis 20. The processing assembly 16 is connected to a first drive shaft 22. The rotor assembly 18 is connected to a second drive shaft 28. The second drive shaft is driven via a suitable pulley assembly 24 by a drive motor 26. The first drive shaft 22 is driven by a suitable pulley assembly 30 associated with the second drive shaft 28.

The pulley assemblies 24 and 30 are conventionally arranged to cause the processing assembly 16 to rotate in the same direction as and at twice the rotational speed of the rotor assembly 18. Examples of this type of construction are more fully disclosed in Lolachi U.S. Pat. 4,113,173.

Figure 2:
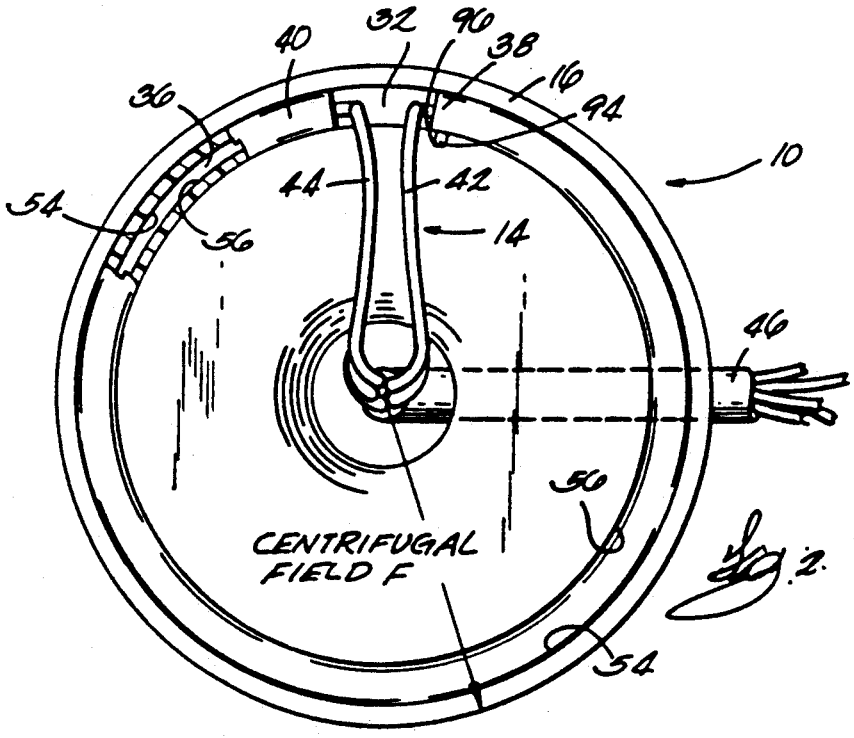
FIG. 2 is a top view of the centrifugal processing system taken generally along line 2—2 in FIG. 1.

As can be best seen in FIGS. 1 and 2, the processing assembly 16 includes an inner processing area 32. The processing area 32 takes the form of an arcuate slot or channel. The slot 32 can be configured in various ways, depending upon the intended use of the system. In the illustrated embodiment (best shown in FIG. 2), the slot 32 is generally equally radially spaced about the rotational axis 20 shared by processing assembly 16 and rotor assembly 18.

Figure 3:
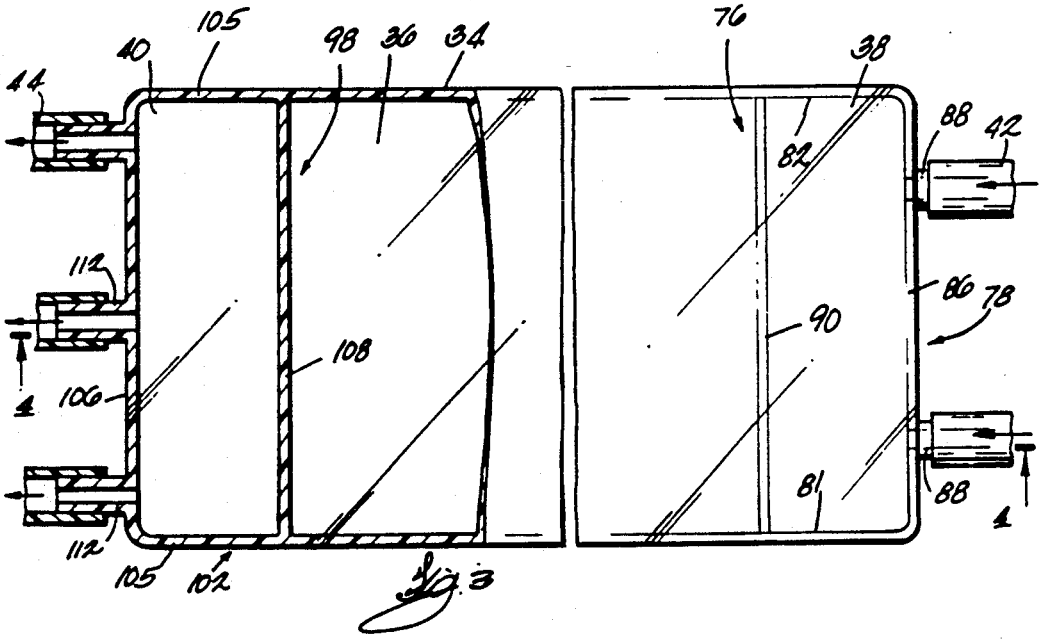
FIG. 3 is an enlarged fragmented top view of the processing tube or envelope of the fluid processing set associated with the system shown in FIG. 1.
Figure 4:
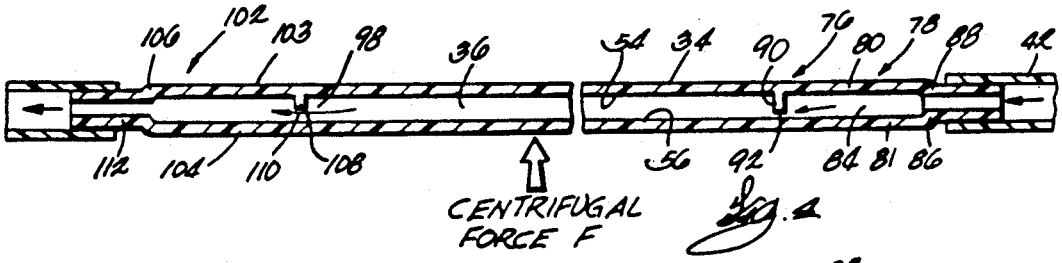
FIG. 4 is a side view of the processing tube or envelope taken generally along line 4—4 in FIG. 3.
Figure 5:
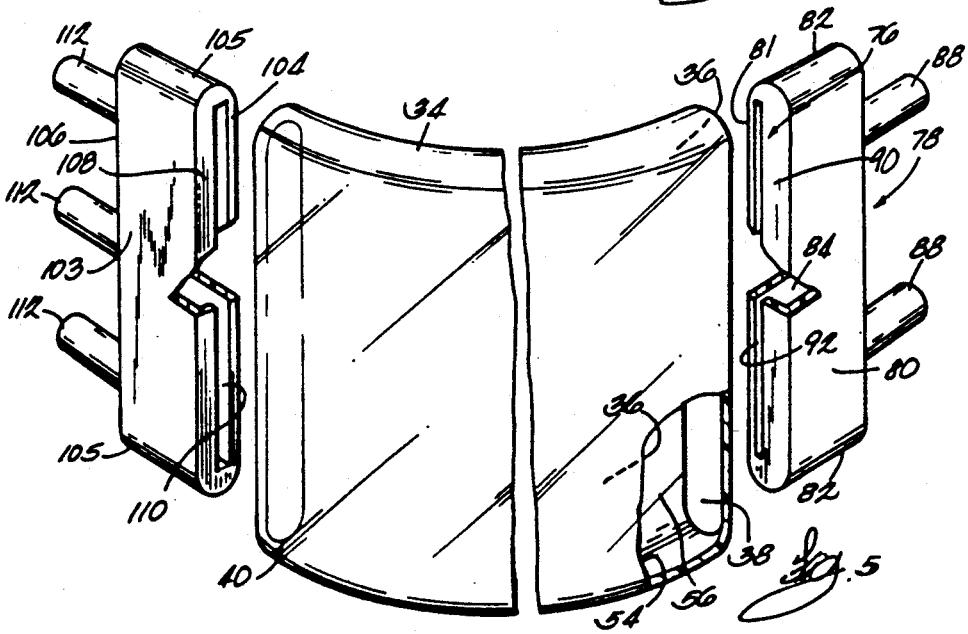
FIG. 5 is an exploded perspective view of the processing tube shown in FIG. 3 showing the associated flow control means.

With further reference now to FIGS. 3 to 5, the fluid processing set 14 includes an envelope or tube 34 defining a hollow interior chamber 36 having an inlet end 38 and an outlet end 40. The tube 34 is intended to be inserted into the processing slot 32 (see FIGS. 1 and 2). As will be soon described in greater detail below, the intended centrifugal separation of the processed fluid occurs within the interior chamber 36 of the tube 34 due to centrifugal forces created during rotation of the processing assembly 16.

The tube 34 is can be made from either a flexible or rigid material. When flexible, the tube 34 can be readily fitted into the slot 32 to there conform to the particular configuration of the slot 32. When rigid, the tube 34 would be preformed to match the particular configuration of the slot 32. In the illustrated embodiment, which contemplates use of the system 10 in the medical field, the tube 34 is made from a flexible medical grade plastic material, such a polyvinyl chloride.

As best shown in FIG. 1, the fluid processing set 14 further includes inlet tubing 42 for conveying fluid into the inlet end 38 of the tube chamber 36 for centrifugal separation. Likewise, the set 14 includes outlet tubing 44 for conveying fluid constituents from the outlet end 40 of the tube chamber 36 after processing.

In the illustrated embodiment, there are two inlet tubes 42 and three outlet tubes 44 (see FIG. 3). Of course, the number of tubes can vary according to the intended use and function of the system 10.

In the illustrated embodiment, the inlet and outlet tubing 42 and 44 are made from flexible medical grade plastic material and are joined to form a multiple lumen umbilicus 46. As best shown in FIG. 1, the umbilicus 46 is suspended from a point above and axially aligned with the rotational axis 20 of the centrifuge 12 by means of a clamp 48 attached to a support arm 50. From this point, the umbilicus 46 extends generally downwardly and radially outwardly, passing against a guide arm 52 carried by the rotor assembly 18. From there, the umbilicus 46 extends generally downwardly and radially inwardly and then upwardly through the hollow center of the drive shaft 22 into the processing assembly 16.

This looping arrangement of the umbilicus 46, coupled with the differing rotational rates of the processing assembly 16 and the rotor assembly 18 as just described, prevents the umbilicus 46 from becoming twisted during operation of the centrifuge 12. The use of rotating seals between the fixed and rotating parts of the system 10 is thereby avoided. However, it should be appreciated that the invention is applicable for use in other types of centrifugal systems, including those employing rotating seals.

Figures 6, 7:
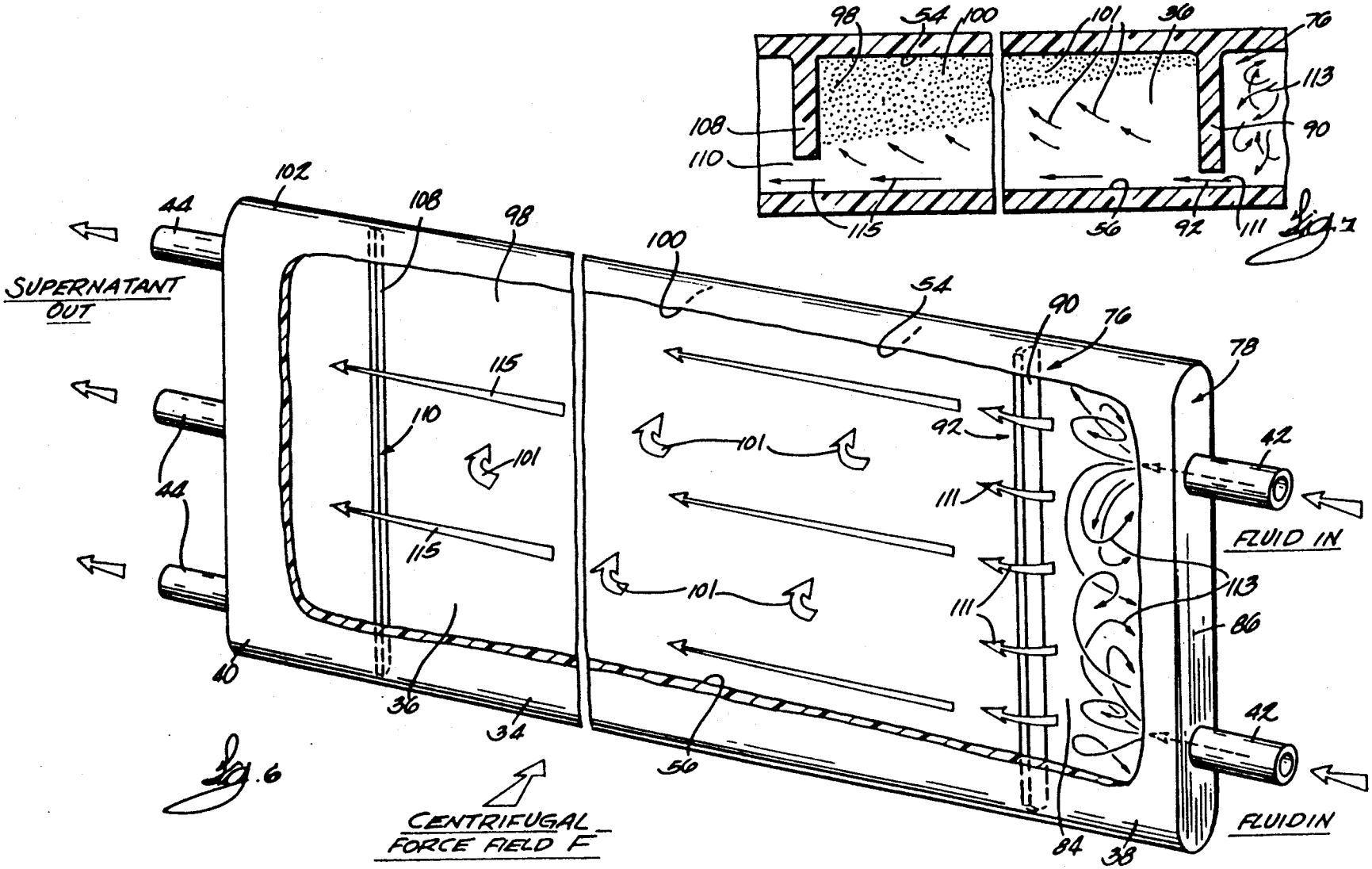
FIG. 6 is an enlarged schematic view, fragmented and broken away in section, of the processing tube or envelope shown in FIGS. 3 to 5 illustrating the flow of fluid through the tube or envelope when it is in use in a centrifugal field.
FIG. 7 is a greatly enlarged schematic view, fragmented and in section, of the collection of higher density materials in the tube or envelope shown in FIG. 6.

Once the tube 34 is located in the processing area 32 and filled with fluid, the rotation of the processing assembly 16 will create a centrifugal force, field F (see FIG. 2) effecting the content of the tube chamber 36. This force field F will create a "High G Region" 54 and a "Low G Region" 56 within the chamber 36. As shown in FIG. 2, the "High G Region 54" is located adjacent to the outer wall of the chamber 36, where the force field is farthest away from the rotational axis and the contents of the chamber 36 are subjected to the highest rotational (or "G") forces. The "Low G Region 56" is located adjacent to the inner wall of the chamber 36, where the force field is nearer to the rotational axis and the contents of the chamber are subjected to lesser rotational (or "G") forces. As best shown in FIGS. 6 and 7, higher density materials present in the processed fluid (designated 101 in FIGS. 6 and 7) will migrate under the influence of the force field F toward the High G Region 54, leaving the less dense materials and supernatant (designated 115 in FIGS. 6 and 7) behind in the Low G Region 56.

To obtained the desired flow rate conditions, the fluid to be processed is introduced into the tube chamber 36 using a suitable in line pumping mechanism 58. In the illustrated embodiment (see FIG. 1), the pumping mechanism takes the form of a peristaltic pump 58 situated upstream of the tube chamber 36.

Figures 4, 8:
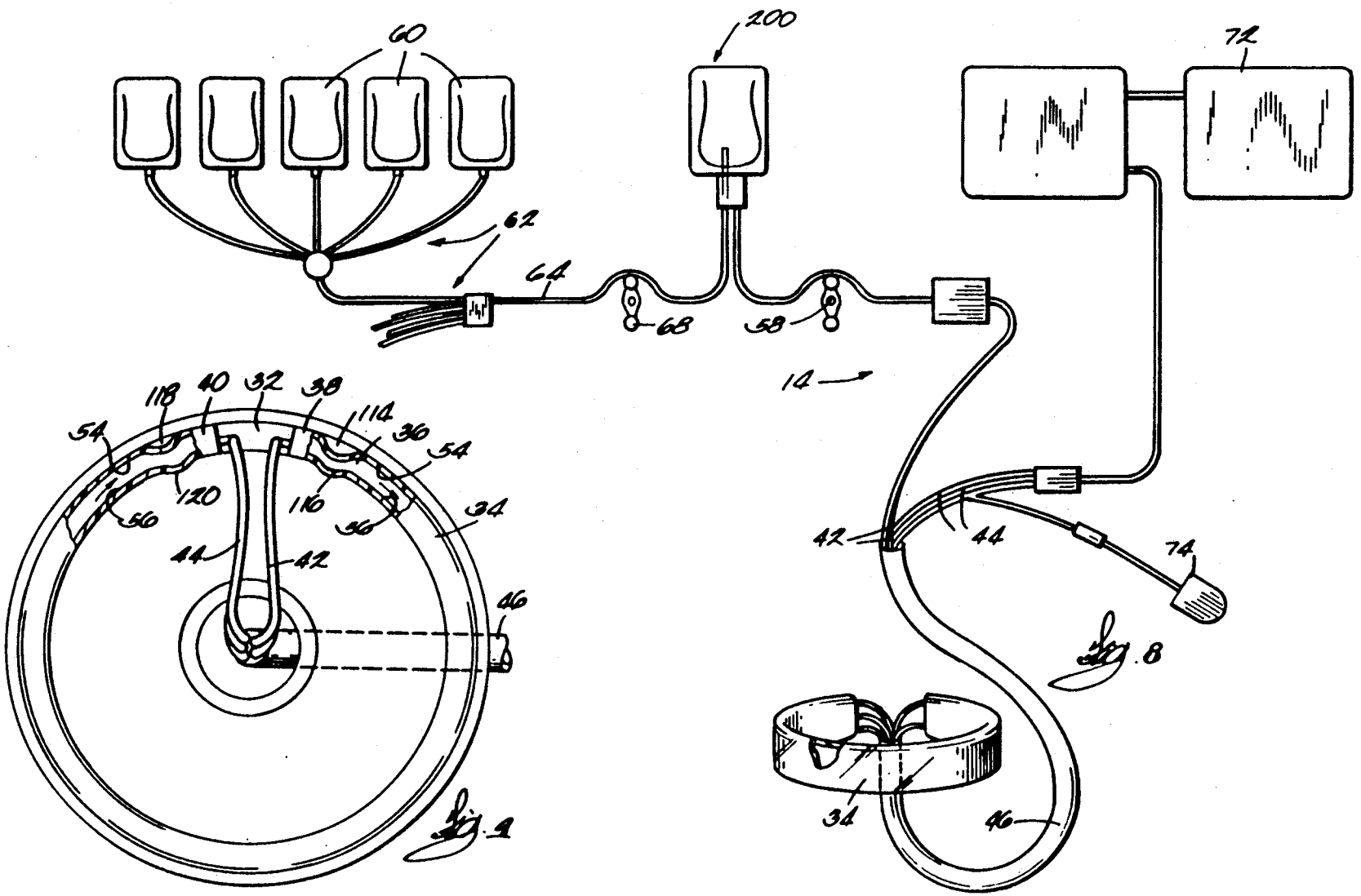
FIG. 8 is a centrifugal fluid processing system embodying the features of the invention and intended to be us in the harvesting of cell cultures on a large volume basis.

In FIG. 8, the set 14 as just described is shown particularly configured for use to harvest TIL cells. In this procedure, cultured TIL cell solution filling approximately 70 to 260 three liter bags 60, each filled with about 1½ liters of solution, is centrifugally processed to remove the supernatant and obtain concentrated TIL cells (which presently consists of approximately $2\times10^{11}$ cells occupying a volume which ranges between 220 to 400 ml).

In this arrangement, 5-lead and 10-lead manifold sets 62 are used to interconnect the many supply bags 60 to a single inlet line 64. The cultured cell fluid is then conveyed into a reservoir bag 66, using the supply pump 68, and then conducted into the tube 34, using the processing pump 58.

In this arrangement, the tube 34 is approximately 32 inches long and 3 inches wide. The interior surface area of the tube 34 is approximately 200 square inches.

During centrifugation, the TIL cells are separated from the culture medium (which constitutes the supernatant). The supernatant is collected in large volume containers 72. Afterwards, the concentrated TIL cells are transferred to a collection container 74 for administration to the patient.

In this and other applications, where relatively large volumes of fluid are to be processed, it is desirable to maximize the inlet flow rate of the fluid, as this will shorten the overall processing time. In the case of a TIL procedure, a nominal processing rate of at least 1.5 liters per minute is attained. However, with the system 10 illustrated, it is believed that the processing rate can be increased upwards to about 4 liters per minute. This rate is significantly higher than the nominal processing rates conventionally used for blood processing (about 50 ml/min) or conventionally used for TIL cell harvesting (about 175 ml/min).

Use of these relatively high inlet flow rates can pose processing problems. In particular, such high rates can lead to confused, turbulent flow conditions within the tube chamber 36. These turbulent or otherwise confused, non-uniform flow conditions can interfere with sedimentation and separation within the centrifugal force field F, lowering the overall effectiveness and efficiency of the process.

High inlet flow rates and attendant confused, turbulent flow conditions can also result in a non-uniform distribution of the fluid within the tube chamber 36. To maximize the effective surface area along which separation occurs, the incoming fluid should preferably enter in the Low G Region 56 as soon as possible after entering the tube 34. The fluid components are thereby exposed to the full extent of the centrifugal force field F for the longest period of time. However, high inlet flow rates can spray or disperse the incoming fluid indiscriminately into both the High and Low G Regions 54 and 56 of the tube 34. This, too, lowers the overall effectiveness and efficiency of the process.

To optimize the effectiveness of separation at high inlet flow rates, the invention provides a fluid processing system 10 that includes means 76 located adjacent the inlet end of the tube chamber 36 for directing incoming fluid away from the High G Region 54 and toward the Low G Region 56 of the chamber 36 in a generally uniform flow having reduced turbulence or being generally free of turbulence. Preferably, the uniform flow constitutes a relatively thin stream filling the entire effective surface area of the Low G Region 56 adjacent to the inlet end of the chamber 36.

In accordance with the invention, the means 76 therefore establishes, upon the entry of high velocity fluid into the centrifugal field F, the desired flow conditions for effective separation. The means 76 also directs and dispenses the fluid in a manner that maximizes the effective surface area of the tube chamber 36 for separation. Due to the invention, effective separation can be achieved, even at high inlet flow rates.

The means 76 can be variously constructed. One embodiment is shown in FIGS. 3 to 5. In this arrangement, the means 76 is part of a port block assembly 78 situated within the inlet end 38 of the tube chamber 36. The assembly 78 includes top, bottom, and side walls 80; 81; and 82 defining an open interior 84. The assembly 78 also includes a first end wall 86 closing the adjacent end of the interior 84. One or more inlet ports 88 are formed on this end wall 86. The inlet tubing 42 is attached to these ports 88 to introduce fluid into the open interior 84 of the assembly 78.

In this arrangement, the means 76 comprises a partial second end wall 90 located on the end of the port block assembly 78 opposite to the end wall 86 on which the inlet ports 88 are situated. This partial end wall 90 extends from the top wall 80 toward the bottom wall 81, terminating a short distance therefrom to there define a flow passage 92 communicating with the open interior 84 of the assembly 78. As will be described in greater detail below, fluid introduced into the open interior 84 of the port block assembly 78 (via the inlet ports 88) is directed into the centrifugal force field through the flow passage 92.

As best shown in FIG. 4, the port block assembly 78 is situated within the inlet end of the tube chamber 36 with the flow passage 92 extending longitudinally across the entire interior surface of the tube chamber 36 which, in use, becomes the Low G Region 56.

To assure that the interior surface of the tube 34 becomes the Low G Region 56 when situated within the processing area 32, a guide key 94 is provided on the port block assembly 78 which mates with a groove 96 in the processing area 32 (see FIG. 2) when the tube 34 is properly oriented.

The system 10 further includes means 98 defining a region 100 for collecting high density materials within the tube chamber 36. In the embodiment shown in FIGS. 2 to 5, the means 98 includes a dam assembly 102 situated within the tube chamber 36 downstream of the port block assembly 78. The dam assembly 102 may be variously constructed. In the illustrated embodiment, the dam assembly 102 is part of another port block assembly as previously described. The assembly 102 includes top and bottom walls 103/104, side walls 105, and an end wall 106.

In this arrangement, the dam assembly 102 comprises a partial end wall 108, which like the means 76 associated with the port block assembly 78, forms another flow passage 110 through which fluid must pass to exit the tube chamber 36.

The length of the end wall 108 associated with the dam assembly 102 can vary. It can be the same as or different than the end wall 90 of the port block assembly 78, depending upon the nature and type of collection area or areas sought to be established within the tube chamber 36. The sedementation of higher density materials in the region 100 is also effected by the fluid flow rate, the RPM of the centrifuge, and the interior thickness of the tube chamber 36. These variables can be adjusted to alter the collection characteristics of the tube 34.

It should also be appreciated that multiple dam assemblies of varying lengths and spacing can be used to create multiple separation and sedimentation zones within the tube chamber 36.

As shown in FIGS. 6 and 7, and as will be described in greater detail below, the higher density materials (designated 101 in FIGS. 6 and 7) migrating toward the High G Region 54 of the chamber 36 will collect within the area 100 bounded by the partial end wall 90 of the port block assembly 78 and the partial end wall 108 of the dam assembly 102.

In the embodiment shown in FIGS. 3 to 5, the dam assembly 102 is located in the outlet end 40 of the tube chamber 36, and outlet ports 112 are accordingly formed on the end wall 106 as in the port block assembly 78. However, it should be appreciated that the dam assembly 102 can be located within the tube chamber 36 at a location upstream of the outlet end 40 of the chamber 36 (as shown in FIG. 6), in which case the end wall 106 would be free of ports. In this arrangement, a separate port block assembly (not shown), without a partial end wall, would be used at the outlet end 40 of the tube chamber 36.

The port block assembly 78 and the dam assembly 102 can be made of various materials. In the illustrated embodiment, both are injection molded plastic parts that are located and sealed within the confines of the tube chamber 36 by heat sealing, solvent sealing, or similar techniques.

The dimensions of the flow passages 92 and 110 can vary according to the type of fluid being processed and the flow conditions desired. In the particular embodiment shown in FIG. 8, the flow passages 92 and 110 are each about 3 inches wide (the same width as the associated tube) and about 0.025 inch in height. The passages 92 and 110 therefore comprises restricted flow passages.

Another embodiment of the means 76 for directing incoming fluid toward the Low G Region 56 is shown in FIG. 9. In this arrangement, the means 76 takes the form of a ridge 114 formed within the outside (High G) side of the processing area 32 of the assembly 16. When the tube 34 is positioned within the processing area 32 (as shown in FIG. 7), the ridge 114 presses against the exterior of the outside wall of the tube 34, thereby forming a passage 92 like that formed by the partial end wall 90 of the port block assembly 78. Preferably, a recess 116 is formed in the inside (Low G) side of the processing area 32 radially across from the ridge 114 to facilitate insertion and removal of the tube 34 and to better define the passage 92.

As also shown in FIG. 9, the means 98 for defining the collection area 100 for higher density materials can also take the form of a ridge 118 and associated recess 120 formed along the walls of the processing area 32 of the centrifuge 12.

A centrifugal processing method which embodies the features of the invention is shown in FIGS. 6 and 7. This process will result by the operation of the above described port block assembly 78 and dam assembly 102 when the tube chamber 36 is exposed to the centrifugal field F. However, it should be appreciated that the process can be achieved by other means as well.

In this method, as the fluid to be processed is introduced into the centrifugal force field F, it is directed away from the region of the chamber 36 where the largest centrifugal (or "G") forces exist. Furthermore, the fluid is directed and dispensed into the force field as a generally uniform stream (designated by arrows and number 111 in FIGS. 6 and 7) having reduced turbulence of being essentially free of turbulence.

Referring specifically now to FIGS. 6 and 7, incoming fluid entering the port block assembly 78 (via the ports 88) is immediately confined within the open interior 84. Turbulent flow conditions occasioned by the entry of fluid into the chamber 36 (indicated by swirling arrows 113 in FIGS. 6 and 7) are thereby effectively confined to this interior area 84 and isolated from the remainder of the tube chamber 36.

The fluid confined within the interior area 84 is directed by the partial end wall 90 away from the High G Region 54 and out into the tube chamber 36 via the passage 92. By virtue of the shape of the passage 92, the fluid is directed and dispensed in a generally uniform stream 111 extending across the Low G Region 56 of the tube chamber 36.

Optimal conditions for sedimentation and separation are thereby quickly established. As a result, the higher density materials 101 migrate due to the force field F toward the High G Region 54. The remaining supernatant (designated by arrows and number 115 in FIGS. 6 and 7) continues to flow uniformly along the Low G Region 56 toward the outlet end 40 of the tube chamber 36.

The process also creates within the chamber 36 a region 100 where the higher density materials 101 collect, while allowing the supernatant 115 to flow freely out of the chamber 36. As can be best seen in FIG. 6, the higher density materials 101 migrating toward the High G Region 54 of the chamber 36 collect within the area 100 bounded by the partial end wall 90 of the port block assembly 78 and the partial end wall 108 of the dam assembly 102. At the same time, the supernatant, which is free of the higher density materials 101, passes through the passage 110 of the dam assembly 102 and exits the outlet end 40 of the tube chamber 36.

EXAMPLE 1

A tube 34 embodying the features of the invention was used in association with a set as generally shown in FIG. 8 and an Adams-type centrifuge to harvest human red blood cells from a saline suspension. Three runs were conducted.

In the first run, the suspension had an original red blood cell concentration of $1.27 \times 10^7$ per ml. This suspension was centrifugally processed through the tube at a flow rate of 1800 ml/min at 1600 RPM. During processing, concentrated red blood cells were collected at processing efficiency of 94.9%.

In the second run, the original suspension concentration was $1.43 \times 10^7$ red blood cells per ml. During centrifugal processing at a flow rate of 1000 ml/min at 1600 RPM, concentrated red blood cells were collected at a processing efficiency of 95.7%.

In the third run, the original suspension concentration was $1.33 \times 10^7$ red blood cells per ml. During centrifugal processing at a flow rate of 1800 ml/min at 1600 RPM, concentrated red blood cells were collected at a processing efficiency of 91.5%.

EXAMPLE 2

A tube 34 embodying the features of the invention was used in association with a set as generally shown in FIG. 8 and an Adams-type centrifuge to harvest TIL cells from suspension.

During the procedure, 24,559 ml of cultured TIL cell suspension was processed through the tube a flow rates varying between 500 to 1500 ml/min at 1600 RPM. 445 ml of concentrated TIL cells were obtained.

Approximately $564.9 \times 10^8$ TIL Cells were contained in the suspension prior to processing. During processing, approximately $462.8 \times 10^8$ TIL cells were collected, for a processing efficiency of 82%.

TIL cell viability of 73% was measured prior to processing. TIL cell viability of 73% was measured after processing.

Lytic activity of the TIL cells prior to processing was 5.4%. After processing, the lytic activity was 4.3%, which does not constitute a statistically significant difference.

The foregoing examples clearly illustrate the ability of a processing system made and operated in accordance with the invention to efficiently process large volumes of cellular suspensions at relatively high fluid flow rates. Example 2 further demonstrates that processing occurs without biological damage to the cellular components.

Various features of the invention are set forth in the following claims.

I claim:

1. A centrifugal chamber for positioning within a rotating field and for centrifugally processing a fluid suspension into component parts, the chamber comprising:

oppositely spaced first and second exterior walls defining a chamber having an interior processing region with an inlet, the first exterior wall, when positioned within the rotating field, being disposed closer to the rotational axis than the second exterior wall to define within the interior processing region a low-g area adjacent the first exterior wall and a high-g area adjacent the second exterior wall, inlet conduit means of a given cross sectional area for conducting the fluid suspension to be processed to the chamber, and wall means forming a fluid receiving area within the inlet of the interior processing region in communication with the inlet conduit means, the fluid receiving area including an interior wall that isolates the fluid receiving area from the interior processing region except for an exit passage that has a cross sectional area greater than the cross sectional area of the inlet conduit means and that extends transversely across the exterior wall for dispensing the fluid suspension conducted by the inlet conduit means only into the log-g area of the processing region in a generally uniform flow free or essentially free of turbulence.

2. A centrifugal chamber according to claim 1 wherein the first and second exterior walls are interconnected together to form a tubular processing chamber.

3. A centrifugal processing system comprising a rotor rotatable about an axis, and a processing chamber carried by the rotor in an arcuate path about the rotational axis, the processing chamber having oppositely spaced first and second exterior walls that enclose an interior processing region with an inlet at one arcuate location and an outlet at another arcuately spaced location on the rotor, the first exterior wall, when positioned within the rotating field, being disposed closer to the rotational axis than the second exterior wall to define within the interior processing region a low-g area adjacent the first exterior wall and a high-g area adjacent the second exterior wall, inlet conduit means of a given cross sectional area for conducting the fluid suspension to be processed to the processing chamber, and wall means forming a fluid receiving area within the inlet of the processing region in communication with the inlet conduit means, the fluid receiving area including an interior wall that isolates the fluid receiving area from the interior processing region except for an exit passage that has a cross sectional area greater than the cross sectional area of the inlet conduit means and that extends transversely across the first exterior wall for dispensing the fluid suspension conducted by the inlet conduit means only into the low-g area of the processing chamber in a generally uniform flow free or essentially free of turbulence.

4. A centrifugal processing method for separating the higher density components of a fluid from the lower density components of the fluid comprising the steps of:

providing a chamber having an interior processing region and an inlet, developing a centrifugal force field within the interior processing region to therein create a low-g area and a high-g area, conveying the fluid to be processed through an inlet path of a given cross sectional area into a receiving area within the inlet to the processing region, the receiving area having an interior wall that isolates the interior processing region from the flow conditions created by conveying the fluid into the receiving area, further conveying the fluid from the receiving area through an exit passage that has a cross sectional area greater than the cross sectional area of the inlet path and that dispenses the fluid in a generally uniform flow free or essentially free of turbulence only into the low-g area of the processing chamber.

5. A centrifugal processing method according to claim 4, and further including the step of creating within the chamber a region confining the higher density components separated within the centrifugal field while allowing the remaining components of the fluid to flow out of the chamber.

* * * * *

UNITED STATES PATENT AND TRADEMARK OFFICE

CERTIFICATE OF CORRECTION

PATENT NO. : 5,078,671

DATED : January 7, 1992

INVENTOR(S) : T. Michael Dennehey and Joseph C. West, Jr.

It is certified that error appears in the above-identified patent and that said Letters Patent is hereby corrected as shown below:

Col. 9, line 43, insert --first-- after "the".

Column 9, line 45, in Claim 1, delete "log-g" and substitute --low-g-- therefor.

Signed and Sealed this

Eleventh Day of May, 1993

*Attest:*

Michael K. Kirk

MICHAEL K. KIRK

*Attesting Officer*

*Acting Commissioner of Patents and Trademarks*